US006618869B1

(12) United States Patent
Jacobs

(10) Patent No.: US 6,618,869 B1
(45) Date of Patent: Sep. 16, 2003

(54) APPARATUS FOR PLACING AND REMOVING SOLAR POOL COVER

(76) Inventor: Teresa Jacobs, 3644 Graff, Ridgecrest, CA (US) 93555

( * ) Notice: Subject to any disclaimer, the term of this patent is extended or adjusted under 35 U.S.C. 154(b) by 0 days.

(21) Appl. No.: 10/072,758

(22) Filed: Feb. 6, 2002

Related U.S. Application Data

(60) Provisional application No. 60/266,539, filed on Feb. 6, 2001.

(51) Int. Cl.[7] ..... E04H 4/00
(52) U.S. Cl. ..... 4/502; 4/503
(58) Field of Search ..... 4/502, 503; 242/397, 242/548.2, 566, 615, 917

(56) References Cited

U.S. PATENT DOCUMENTS

| | | | | | |
|---|---|---|---|---|---|
| 3,574,979 | A | * | 4/1971 | Chan | 52/2.21 |
| 4,285,078 | A | | 8/1981 | Batstone | |
| 4,470,404 | A | * | 9/1984 | Kremen | 4/502 |
| 4,471,500 | A | * | 9/1984 | Long et al. | 4/502 |
| 5,184,356 | A | | 2/1993 | Lof et al. | |
| 5,205,605 | A | * | 4/1993 | Haddad, Jr. | 242/397 |
| 5,425,143 | A | * | 6/1995 | Kalandovsky | 4/502 |
| 5,503,211 | A | * | 4/1996 | Engi | 160/290.1 |
| 5,701,613 | A | * | 12/1997 | Richardson | 4/502 |
| 5,930,848 | A | * | 8/1999 | Last | 4/502 |
| 6,421,845 | B1 | * | 7/2002 | Bertoni | 4/502 |
| 2001/0023506 | A1 | * | 9/2001 | Mathis et al. | |
| 2001/0029626 | A1 | * | 10/2001 | Mathis | |

FOREIGN PATENT DOCUMENTS

| | | | | |
|---|---|---|---|---|
| DE | 3026956 | * | 2/1982 | 4/502 |
| FR | 2450927 | * | 11/1980 | 4/502 |

OTHER PUBLICATIONS

US 2001/0029626 A1; Oct. 18, 2001; Mathis.*
US 2001/0023506 A1; 09/27/2001; Mathis et al.*

* cited by examiner

*Primary Examiner*—Gregory L. Huson
*Assistant Examiner*—Khoa D. Huynh
(74) *Attorney, Agent, or Firm*—Matthew Pierce

(57) ABSTRACT

A new and improved apparatus is disclosed for rolling up and laying out a solar pool cover over a pool. The apparatus comprises a two support frames, two reel supports, and a reel shaft that is mounted atop the two support frames. The two support frames are located opposite one another across the width of the pool. The solar pool cover is wound around the reel shaft. The reel shaft is hooked up to a motor which is atop one of the support frames.

4 Claims, 1 Drawing Sheet

APPARATUS FOR PLACING AND REMOVING SOLAR POOL COVER

Priority is hereby claimed to application 60/266,539, filed on Feb. 6, 2001.

I. BACKGROUND OF THE INVENTION

The present invention is that of a new and improved apparatus for rolling up and laying out a solar pool cover over a pool.

II. DESCRIPTION OF THE PRIOR ART

U.S. Pat. No. 5,184,356, issued to Lof et al., discloses a system for deploying and retrieving a cover over a swimming pool.

U.S. Pat. No. 4,471,500, issued to Long et al., discloses a self-rolling swimming pool cover which extends when connected to a pressure source and returns to a rolled position when disconnected therefrom.

U.S. Pat. No. 4,285,078, issued to Batstone, discloses an automatic cover for a liquid storage container and a method of control corresponding thereo.

III. SUMMARY OF THE INVENTION

The present invention is that of a new and improved apparatus for rolling up and laying out a solar pool cover over a pool. The apparatus comprises a two support frames, two reel supports, and a reel shaft that is mounted atop the two support frames. The two support frames are located opposite one another across the width of the pool. The solar pool cover is wound around the reel shaft. The reel shaft is hooked up to a motor which is atop one of the support frames.

There has thus been outlined, rather broadly, the more important features of an apparatus for rolling up and laying out a solar pool cover that the detailed description thereof that follows may be better understood and in order that the present contribution to the art may be better appreciated. There are, of course, additional features of the apparatus for rolling up and laying out a solar pool cover that will be described hereinafter and which will form the subject matter of the claims appended hereto.

In this respect, before explaining at least one embodiment of the apparatus for rolling up and laying out a solar pool cover in detail, it is to be understood that the apparatus for rolling up and laying out a solar pool cover is not limited in its application to the details of construction and to the arrangements of the components set forth in the following description or illustrated in the drawings. The apparatus for rolling up and laying out a solar pool cover is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present apparatus for rolling up and laying out a solar pool cover. It is important, therefore, that the claims be regarded as including such equivalent constructions insofar as they do not depart from the spirit and scope of the present invention.

It is therefore an object of the present invention to provide an apparatus for rolling up and laying out a solar pool cover which has all of the advantages of the prior art and none of the disadvantages.

It is another object of the present invention to provide an apparatus for rolling up and laying out a solar pool cover which may be easily and efficiently manufactured and marketed.

It is another object of the present invention to provide an apparatus for rolling up and laying out a solar pool cover which is of durable and reliable construction.

It is yet another object of the present invention to provide an apparatus for rolling up and laying out a solar pool cover which is economically affordable and available for relevant purchasing government entities.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
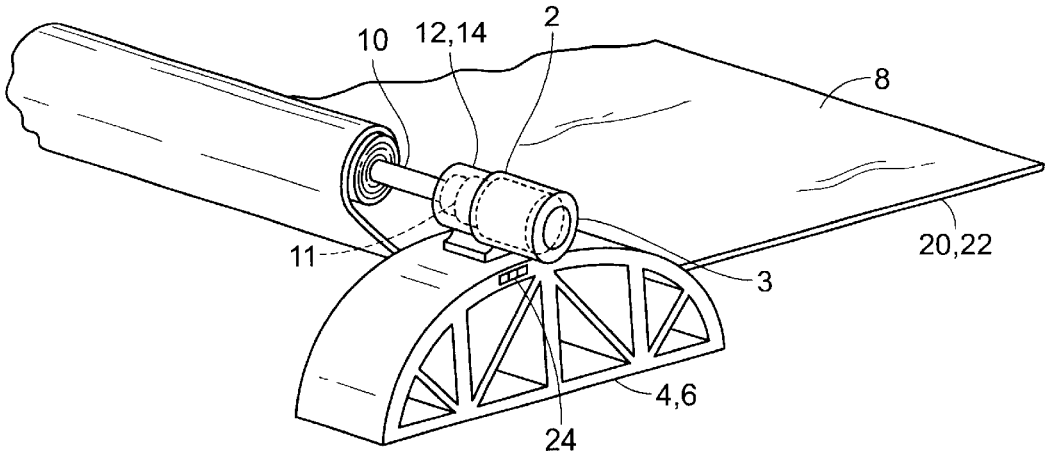
FIG. 1 shows a close-up perspective view of the motor casing and the motor atop a support frame of the present invention.

FIG. 1 shows a close-up perspective view of the motor casing 3 and the motor 2 atop a support frame of the present invention. Support frames 4 and 6 are used to support the reel shaft 10 of the present invention. Reel shaft 10 has two ends, a first end and a second end. Atop support frames 4 and 6 are located reel supports 12 and 14, respectively. The first end of reel shaft 10 can be placed within reel support 12, while the second end of reel shaft 10 can be placed within reel support 14.

Each support frame of the present invention would be semicircular in shape and would have a wide, flat base to afford stability to the present invention. The support frames would be located opposite one another on opposite ends of a pool. The reel shaft 10, atop support frames 4 and 6, would traverse across the width of a pool.

Each end of reel shaft 10 would be placed within a circular ball bearing assembly 11, with a ball bearing assembly 11 being located within reel support 12 and reel support 14. Reel support 14 would be connected to a drive shaft within motor 2. Motor 2 would sit atop support frame 6 within motor casing 3. Motor 2 would be powered by standard household current and would be controlled by a three-position switch 24 that would have positions "off" "extend," and "retract." The extend position would be designed to extend the solar pool cover over the entire length of the pool, while the retract position would be designed to retract the solar pool cover from the entire length of the pool Solar pool cover 8 would have two ends, a first end and a second end, with the first end of solar pool cover 8 being wrapped around reel shaft 10. Solar pool cover would have plastic rods 20 and 22 along its length, with plastic rods 20 and 22 fabricated from a semi-rigid plastic which is integrally incorporated into the sides of solar pool cover 8 to afford substance and weight to solar pool cover 8 to enable solar pool cover 8 to be directionally propelled by motor 2 whenever motor 2 is activated.

The present invention would be quite useful for keeping a pool covered. In addition, the present invention is very useful in storing a solar pool cover when it is not use, but at the same time, allowing the pool to be covered by the solar pool cover in a quick and efficient manner.

Figure 2:
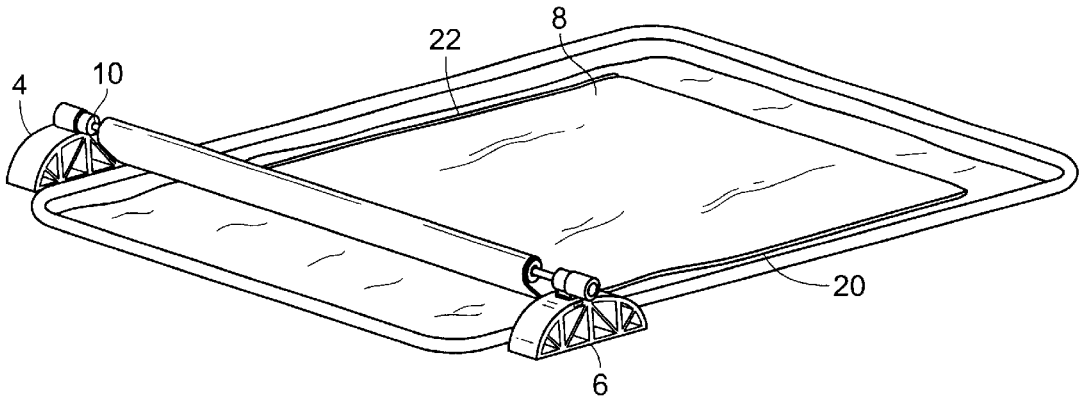
FIG. 2 shows a perspective view of the present invention as it would appear in use.

FIG. 2 shows a perspective view of the present invention as it would appear in use.

What I claim as my invention is:

1. An apparatus for rolling up and laying out a solar pool cover over a pool in combination with a solar pool cover comprising:

(a) a reel shaft having two ends, a first end and a second end, the reel shaft being cylindrical, (b) a pair of reel supports, a first reel support and a second reel support, the first end of the reel shaft placed on top of the first reel support, the second end of the reel shaft placed on top of the second reel support, (c) a pair of ball bearing assemblies, a first ball bearing assembly and a second ball bearing assembly, the first ball bearing assembly located within the first reel support, the second ball bearing assembly located within the second reel support, the ball bearing assemblies serving to allow rotation of the reel support, (d) a pair of support frames, a first support frame and a second support frame, each support frame having a semicircular shape, the first end of the reel shaft being fixedly attached to the top of the first support frame, the second end of the reel shaft being fixedly attached to the top of the second support frame, (e) a motor casing attached to the top of the second support frame immediately adjacent to the second reel support, (f) a motor located within the motor casing, (g) power means for providing power to the motor, (h) a multi-position switch for controlling the motor, (i) wherein the solar pool cover would have two ends, a first end and a second end, the first end of the solar pool cover being attached to the reel shaft, further wherein the entire length of the solar pool cover would be wound around the reel shaft when not in use, j) further wherein the reel shaft would be placed over a pool, the pool preferably being square or rectangular, the pool having at least four straight sides, two of the straight sides being considered "ends" and two of the straight sides being considered "side edges," each of the two support frames being placed immediately adjacent to a side edge of the pool, with the reel shaft being located over pool near a side edge of the pool.

2. An apparatus for rolling up and laying out a solar pool cover over a pool in combination with a solar pool cover according to claim 1 wherein the solar pool cover would have a length and a width, the solar pool cover having two long sides and two short sides, the two long sides spanning the length of the solar pool cover and the short sides spanning the width of the solar pool cover, the solar pool cover further comprising a pair of flexible rods, a first flexible rod and a second flexible rod, wherein the first flexible rod would be integrally incorporated to the solar pool cover along the entire length of the first long side and the second flexible rod would be integrally incorporated to the solar pool cover along the entire length of the second long side.

3. An apparatus for rolling up and laying out a solar pool cover over a pool in combination with a solar pool cover according to claim 1 wherein the power means for the motor would be standard household current.

4. An apparatus for rolling up and laying out a solar pool cover over a pool in combination with a solar pool cover according to claim 1 wherein the multi-position switch would have three position, with the three positions being "off," "extend," and "retract," the "off" position serving to cut power from the power means to the motor, the "extend" position serving to rotate the reel shaft in a direction so as to cause the solar pool cover to be unwound from the reel shaft, and the "retract" position serving to rotate the reel shaft in a direction so as to cause the solar pool cover to be retrieved from the top of the pool and wound around the reel shaft.

* * * * *